US005465884A

United States Patent [19]

Bohl et al.

[11] Patent Number: 5,465,884

[45] Date of Patent: Nov. 14, 1995

[54] CRUTCH PACK

[76] Inventors: Eric E. Bohl, 5920 Walraven Cir., Fort Worth, Tex. 76133; Brent Hale, 902 Haden, Tyler, Tex. 75701; Tim Parker, 12640 J. Rewan Rd., Burleson, Tex. 76028

[21] Appl. No.: 248,959

[22] Filed: May 25, 1994

[51] Int. Cl.[6] ..... A45B 1/00

[52] U.S. Cl. ..... 224/407; 224/0.5; 224/563; 224/572; 224/901; 135/66

[58] Field of Search ..... 224/42.46 R, 0.5, 224/210, 212; 135/66

[56] References Cited

U.S. PATENT DOCUMENTS

| | | | |
|---|---|---|---|
| D. 316,776 | 5/1991 | Yarus | D3/11 |
| D. 324,504 | 3/1992 | Olsen | D12/133 |
| D. 328,519 | 8/1992 | Tom | D3/10 |
| D. 343,055 | 1/1994 | Child | D3/48 |
| 2,311,049 | 2/1943 | Hedden | 135/49 |
| 2,423,635 | 7/1947 | Blum | 135/47 |
| 2,553,730 | 5/1951 | Taylor | 135/47 |
| 2,745,465 | 5/1956 | Hogan | 155/23 |
| 2,750,951 | 6/1956 | Barnwell | 135/47 |
| 2,912,991 | 11/1959 | Shinn | 135/47 |
| 3,429,541 | 2/1969 | Herman | 248/302 |
| 3,545,462 | 12/1970 | O'Mahoney | 135/47 |
| 3,889,859 | 6/1975 | Jospeh | 224/212 X |
| 3,957,071 | 5/1976 | Kenner | 135/47 |
| 3,985,148 | 10/1976 | Cadman | 135/66 |
| 4,027,687 | 6/1977 | McGowan | 135/66 |
| 4,074,683 | 2/1978 | DiChiara | 135/67 |
| 4,146,045 | 3/1979 | Grant | 135/66 |
| 4,184,618 | 1/1980 | Jones | 224/42.46 |
| 4,289,156 | 9/1981 | Ulics | 135/66 |
| 4,295,483 | 10/1981 | Smith | 135/66 |
| 4,428,390 | 1/1984 | Baird | 135/66 |
| 4,676,416 | 6/1987 | Harmon | 224/42.46 |
| 4,800,911 | 1/1989 | Endres | 135/67 |
| 4,850,383 | 7/1989 | McBride | 135/66 |
| 4,974,620 | 12/1990 | Quillan | 135/67 |
| 4,974,760 | 12/1990 | Miller | 224/42.46 |
| 5,012,963 | 5/1991 | Rosenbaum | 224/42.46 |
| 5,048,849 | 9/1991 | Mathews | 280/47.35 |
| 5,101,845 | 4/1992 | Kravetz | 135/66 |
| 5,340,005 | 8/1994 | Woods | 224/42.46 |

*Primary Examiner*—Renee S. Luebke
*Attorney, Agent, or Firm*—Geoffrey A. Mantooth

[57] ABSTRACT

A carrying pack for a crutch and a method for using the pack are provided. The carrying pack has plural side walls and a bottom wall that are integrally coupled together about a cavity. Flaps extend from a back side wall for location about crutch arms. The flaps have apertures extending therethrough that accept the shaft of a crutch hand grip bolt therethrough. The hand grip bolt secures the flaps to the crutch arms, securing the pack to the crutch. Straps also extend from the back side wall. The straps may be cinched about the crutch to stabilize the pack on the crutch. Inner and outer pockets are provided in the carrying pack for further storage space.

14 Claims, 1 Drawing Sheet

CRUTCH PACK

FIELD OF THE INVENTION

The present invention relates to packs for carrying items, in particular, to a pack that may be secured to a crutch for carrying items on the crutch.

1. Background of the Invention

Crutches are used to increase the mobility of persons with an injured leg. A crutch user frequently may encounter difficulty carrying items while using the crutches because the crutch user's hands are required to grasp crutch handle grips to manipulate the crutches, and therefore are not free to carry items. Items that a healthy person can carry easily may be impossible for a crutch user to carry while manipulating the crutches. Even items that the crutch user can hold while manipulating the crutches may prove difficult or uncomfortable to carry while using the crutches.

2. Summary of the Invention

Therefore, it is an object of the present invention to provide a carrying pack for attachment to a crutch for receiving and retaining items in the pouch.

It is a further object of the present invention to provide a method for storing and carrying items on a crutch.

A bag is provided having plural walls coupled together about a cavity. A pouch opening communicating with the cavity is located in at least one of the walls. The cavity is capable of receiving and storing items through the pouch opening. One of the walls is a first wall which has first and second flaps coupled thereto. The flaps extend out from the first wall and are spaced apart to receive a crutch therebetween. The crutch has a crutch handle bolt removably extending through a hand grip and through first and second crutch arms to fasten the hand grip between the crutch arms. The first and second flaps are located along the first and second crutch arms, respectively. First and second openings in the first and second flaps, respectively, are positioned in the flaps to receive the crutch handle bolt therethrough. A support strap is coupled to the first wall extending outwards from the first wall. The strap has coupling means for coupling the strap about the crutch to stabilize the bag on the crutch.

In order to store and carry items on a crutch, the carrying pack and a crutch with a hand grip secured to the crutch by a coupler are provided. The hand grip is unsecured from the crutch by uncoupling the coupler. The coupler is then recoupled to the crutch to secure the hand grip and the carrying pack to the crutch.

DESCRIPTION OF THE PREFERRED EMBODIMENT

Figure 1:
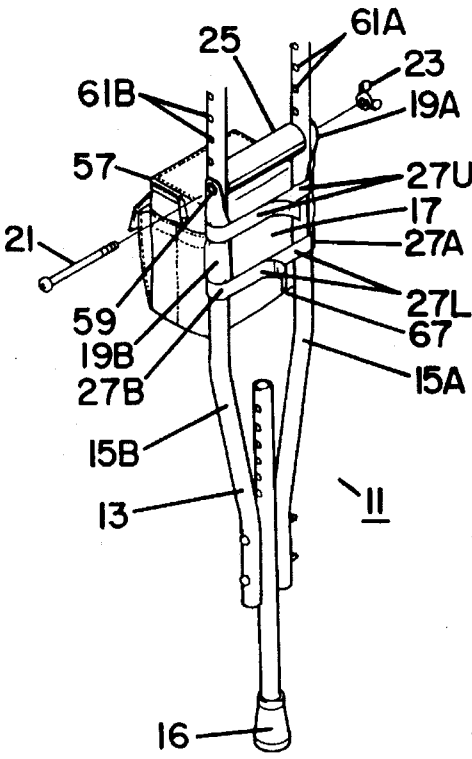
FIG. 1 is an isometric rear view of the crutch carrying pack of the present invention, located on a crutch.

Referring now to FIG. 1, a preferred embodiment of the crutch carrying pack 11 of the present invention is shown. The crutch carrying pack 11 is a fabric bag removably coupled to a crutch 13. The crutch carrying pack 11 provides a convenient storage space for items being carried about by a user of the crutch 13.

The crutch 13 is a conventional, commercially available crutch which includes an adjustable hand grip 25 that extends between crutch arms 15A and 15B. The crutch is of the type used to aid a human in walking. The crutch has a pad on top (not shown) which fits under the arm of a person using the crutch. The crutch may be used singly or may be part of a matched pair of crutches.

A plurality of opposing hand grip adjustment apertures 61A and 61B extend vertically through the crutch arms 15A and 15B, respectively, to permit adjustment of the height of the hand grip 25 in the crutch 13. The hand grip 25 is secured between the crutch arms 15A and 15B at a selected distance from tip 16 by a bolt 21 and a nut 23. The bolt 21 extends through the hand grip 25 and through a pair of hand grip adjustment apertures 61A and 61B in the crutch arms 15A and 15B, respectively, and is fastened in place by the nut 23 which threadably couples to the end of the bolt 21.

The crutch carrying pack 11 is securely coupled to crutch arms 15A and 15B to fasten the pack to the crutch 13. A back wall 17 of the pack 11 is positioned against the crutch arms 15A and 15B extending between the crutch arms. Flaps 19A and 19B are coupled to and extend from the back wall 17 of the pack 11. The flaps 19A and 19B extend adjacent to and are coupled to the crutch arms 15A and 15B, respectively, adjacent a pair of hand grip adjustment apertures 61A and 61B and opposite the hand grip 25 of the crutch 13. The bolt 21 extends through the flaps 19A and 19B, crutch arms 15A and 15B, and the hand grip 25. The nut 23 is threadably coupled about the end of the bolt 21 to tightly secure the flaps 19A and 19B, as well as the crutch hand grip 25, to the crutch arms 15A and 15B. Securing straps 27U and 27L coupled to the back wall 17 of the pack 11 are fastened about the crutch arms 15A and 15B to stabilize the pack on the crutch 13.

Figure 2:
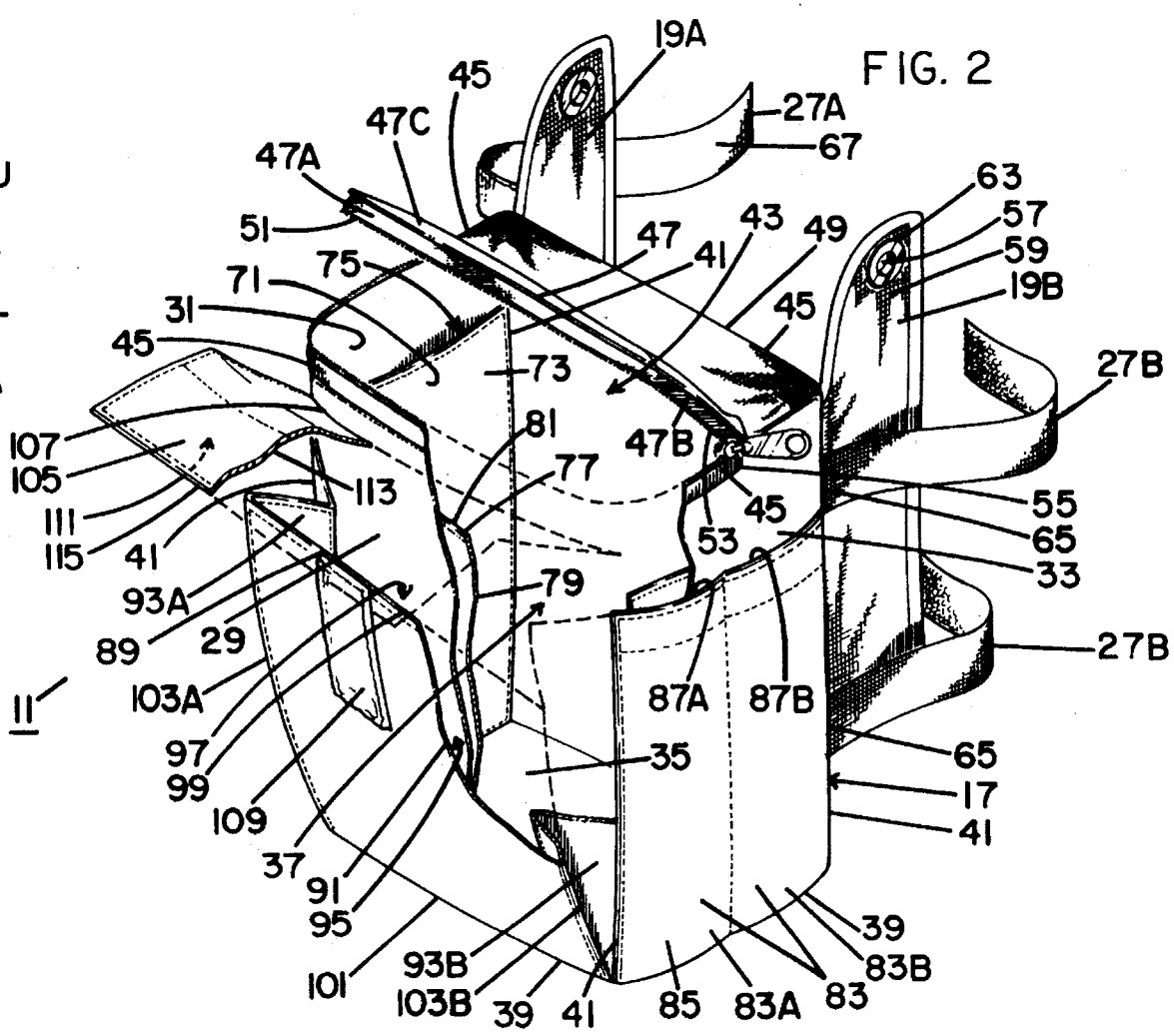
FIG. 2 is a front isometric view of the crutch carrying pack shown with the top partially open and the pack partially cut away.

Referring now to FIG. 2, the crutch carrying pack 11 will be described in more detail. The crutch carrying pack 11 has the back wall 17, a front wall 29, side walls 31 and 33, and a bottom wall 35 which are coupled together about a main cavity 37. The walls 17, 29, 31, 33 and 35 are formed of fabric and are sewn together about bottom edges 39 and side edges 41. In a preferred embodiment, the walls are formed of a tough, heavy duty waterproof fabric such as marine canvas or marine tarp. A pack opening 43 extends through the top edges 45 of the front, back and side walls 29, 17, 31 and 33 opposite the bottom wall 35. The pack opening 43 communicates with the main cavity 37 so that items may be located in the main cavity through the pack opening.

In a preferred embodiment, a top wall 47 is removably secured about the top edges 45 of the pack 11 over the pack opening 43 so that items in the cavity 37 are not subject to falling out of the pack. The top wall 47 is formed of the same fabric material as the walls 17, 29, 31, 33 and 35. The back edge 49 of the top wall 47 is coupled to the top edge 45 of the back wall 17. The front and side edges 51 and 53 of the top wall 47 are removably coupled to the top edges 45 of the front and side walls 29, 31 and 33, respectively, so the top wall 47 may be alternatively opened or secured in a closed position. In a preferred embodiment, a zipper 55 extends along the front and side edges 51 and 53 of the top wall 47 and along the top edges 45 of the front and side walls 29, 31 and 33 for removably coupling the front and side edges 51 and 53 of the top wall 47 to the front and side walls 29, 31, and 33. In another embodiment, the top wall has front and side overhanging portions and which extend down from a top portion of the top wall to couple the top edges of the front and side walls, which are located below the top edge of the back wall.

Referring still to FIG. 2, each flap 19A and 19B is coupled to the back wall 17 extending from the top edge 45 towards the bottom edge 39 of the back wall 17. The flaps 19A and 19B extend generally parallel to one another and are spaced apart sufficiently to be located about the crutch arms 15A and 15B, respectively. In a preferred embodiment, each flap 19A and 19B is coupled to a side edge 41 joining the back wall 17 and a side wall 31 or 33, respectively. The flaps 19A and 19B are flexible, preferably being formed of the same fabric material as the walls 17, 29, 31 and 33 of the pack 11 so that the flaps 19A and 19B may be easily positioned about the crutch arms 15A and 15B, respectively.

A coupling aperture 57 extends through each flap 19A and 19B for receiving the bolt 21 of the hand grip 25 therethrough. As shown in FIG. 1, each coupling aperture 57 is located in an outer portion 59 of its flap 19A or 19B sufficiently spaced from the back wall 17 of the pack 11 so that the coupling aperture 57 may be located over and aligned with a hand grip adjustment aperture 61A or 61B in a crutch arm 15A or 15B. In a preferred embodiment, the outer portion 59 of each flap 19A and 19B is located upwardly from the top edge 45 of the back wall 17 of the pack 11 so the pack may hang from the outer portions 59 of the flaps 19A and 19B when the flaps are coupled to the crutch arms 15A and 15B.

Referring back to FIG. 2, a metal grommet 63, preferably brass, is located about each coupling aperture 57 to prevent the fabric about the coupling apertures 57 from being torn. The diameter of the grommet 63 is large enough to permit the shaft of the bolt 21 to pass therethrough, but is smaller than the head of the bolt and the nut 23 so that the pack 11 may be retained on the crutch 13 by the bolt 21 and nut 23 located against the grommets 63 in the flaps 19A and 19B.

Referring to FIGS. 1 and 2, upper and lower securing straps 27U and 27L are attached to the pack 11 for stabilizing the pack on the crutch 13. The upper strap 27U extends outward from the side edges 41 of the back wall 17 near the middle of the back wall 17, and the lower strap 27L extends outward from the side edges 41 of the back wall 17 near the bottom edge 39 of the back wall 17. The upper strap 27U secures the center portion of the pack 11 to the crutch 13, and the lower strap 27L secures the lower portion of the pack to the crutch, while the flaps 19A and 19B secure the upper portion of the pack to the crutch. Although the pack 11 preferably is formed having two securing straps 27U and 27L, more or less than two straps may be used to stabilize the pack on the crutch 13, if desired.

The securing straps 27U and 27L are coupled to the back wall 17 positioned to extend about the crutch arms 15A and 15B. Each securing strap 27U and 27L has first and second portions 27A and 27B. The strap portions 27A and 27B are flexible, and preferably are formed of a braided nylon material. Each strap portion 27A and 27B is secured to the back wall 17 of the pack 11 at a pack end 65 of the strap portion 27A or 27B. In a preferred embodiment, the pack end 65 of each strap portion 27A and 27B is sewn to a side edge 41 joining the back wall 17 and a side wall 31 or 33, respectively.

As shown in FIG. 1, the strap portions 27A and 27B extend from the back wall 17 of the pack 11 around the crutch arms 15A and 15B to stabilize the pack on the crutch 13. Each strap portion 27A and 27B extends lengthwise from its pack end 65 to a coupling end 67. The length of the combined strap portions 27A and 27B is sufficient for the strap portions 27A and 27B to cooperatively extend from the back wall 17 around the crutch 13.

The coupling end 67 of each strap portion 27A and 27B is removably secured to the coupling end 67 of the opposing strap portion 27A or 27B to secure the strap 27U or 27L about the crutch 13. In a preferred embodiment, as shown in FIG. 2, the coupling end of the strap portion 27A has a hook type fastener and the coupling end of strap portion 27B has a loop type fastener. The strap portions 27A and 27B are secured together about the crutch 13 by pulling the strap portions taut about the crutch arms 15A and 15B, wrapping the taut strap portions about the crutch, and joining the hook and loop type fasteners on the respective coupling ends of the strap portions together. FIG. 1 shows ends pulled back for illustrative purposes only. Although hook and loop type fasteners are the preferred means for coupling the strap portions 27A and 27B together, other type fasteners such as snap fasteners or buckle type fasteners may be used to join the strap portions.

Referring still to FIG. 2, in addition to the main cavity 37, the pack 11 has several pockets for carrying items. Inner side pockets 71 are located on the side walls 31 and 33 inside the pack 11 adjacent to the main cavity 37. Each inner side pocket 71 is formed by an inner side pocket wall 73 coupled to a respective side wall 31 or 33 along the bottom and sides of the inner side pocket wall 73 with an inner side pocket opening 75 located facing the pack opening 43 communicating with an inner side pocket cavity. The inner side pocket wall 73 of each inner side pocket 71 is formed of the same fabric material as the walls 17, 29, 31 and 33 of the pack 11, and is coupled to its respective side wall 31 or 33 by being sewn to the side wall. In a preferred embodiment, each inner side pocket wall 73 extends from the top edge 45 of its respective side wall 31 or 33 about halfway down the side wall. Credit cards, a driver's license, or money may be stored in the inner side pockets 71 and may be easily retrieved from the shallow inner side pockets.

An inner front pocket 77 is located on the front wall 29 inside the pack 11 adjacent to the main cavity 37. The inner front pocket 77 is formed by an inner front pocket wall 79 coupled to the front wall 29 along the bottom and sides of the front pocket wall 79 with an inner front pocket opening 81 located facing the pack opening 43 communicating with an inner front pocket cavity. The inner front pocket wall 79 is formed of the same fabric material as the walls 17, 29, 31, and 33, and is coupled to the front wall 29 by being sewn to the front wall 29. The inner front pocket 77 extends substantially the length and width of the front wall 29.

Outer side pockets 83 are located on the side walls 31 and 33, respectively, on the outside of the pack 11. Each outer side pocket 83 extends lengthwise from a position proximate to the bottom edge 39 of its side wall 31 or 33 upwards a substantial portion of the length of the side wall. Each outer side pocket 83 is formed by an outer side pocket wall 85 coupled to its respective side wall 31 or 33 along the bottom and sides of the outer side pocket wall 85. The outer side pocket wall 85 of each outer side pocket 83 is formed of the same fabric material as the walls 17, 29, 31 and 33 of the pack, and is coupled to its respective side wall 31 or 33 by being sewn to the side wall. In a preferred embodiment, the outer side pocket wall 85 of each outer side pocket 83 is sewn to its respective side wall 31 or 33 lengthwise through the center of the outer side pocket wall 85 from the top to the bottom of the wall 85 to form two side pockets 83A and 83B having side pocket openings 87A and 87B communicating with outer side pocket cavities. The side pockets 83A and 83B are useful for receiving and retaining pencils and pens.

A front pocket 89 is located on the front wall 29 on the outside of the pack 11. The front pocket 89 is formed by a front pocket wall 91, and front pocket side walls 93A and 93B coupled to the front wall 29. The walls 91, 93A, 93B and 29 extend about a front pocket cavity 95 which may be used to store items. A front pocket opening 97 is located extending through the top edges 99 of the front pocket wall 91 and the front pocket side walls 93A and 93B. The front pocket opening 97 communicates with the front pocket cavity 95 so that items may be located in the front pocket cavity through the front pocket opening.

The walls 91, 93A and 93B are formed of the same fabric material as the front wall 29 and are coupled together by being sewn along edges of the walls 91, 93A and 93B. The bottom edge 101 of the front pocket wall 91 is coupled to the front wall 29 near the bottom edge 39 of the front wall 29, and the front pocket wall 91 extends upwards to its top edge 99 across a substantial portion of the face of the front wall 29. The front pocket side walls 93A and 93B are coupled to and extend between the front wall 29 and side edges 103A and 103B of the front pocket wall 91 which are located proximate to the side edges 41 of the front wall 29. The front pocket side walls 93A and 93B fold between the front pocket wall 91 and the front wall 29 so the front pocket wall 91 may be pulled to an open position with the front pocket side walls 93A and 93B unfolded, or pushed to a closed position with the front pocket side walls folded.

A front pocket flap 105 is positioned to removably cover the front pocket opening 97. The front pocket flap 105 is formed of the same fabric material as the walls 91, 93A, 93B and 29. A top edge 107 of the flap 105 is sewn to the front wall 29 across the width of the front wall 29 so the flap 105 may hang down over the top edges 99 of the walls 91, 93A and 93B to cover the front pocket opening 97. The flap 105 may be alternatively lifted to provide access to the front pocket opening 97 or lowered to cover the front pocket opening.

The flap 105 has means for removably coupling the flap to the front pocket wall 91 so that the front pocket 89 may be secured to prevent items from falling out of the pocket 89. In a preferred embodiment, hook type fastener 109 and loop type fastener 111 are used to removably secure the flap 105 to the front pocket wall 91. The front pocket wall 91 includes a strip of hook type fastening material 109 located extending widthwise across the face of the front pocket wall slightly below the top edge 99 of the wall 91. The flap 105 has a strip of loop type fastening material 111 located extending widthwise across the inner surface 113 of the flap slightly above the bottom edge 115 of the flap. The strips 109 and 111 overlap and may be fastened together when the flap 105 is located in a closed position over the front pocket opening 97. Although hook and loop type fasteners are the preferred means of removably securing the flap to the front pocket wall, other fastening means such as snap fasteners may be used instead.

The crutch carrying pack 11 is easily attached to a crutch 13. Initially, the hand grip 25 of the crutch is removed from between the crutch arms 15A and 15B by loosening and removing the nut 23 from the bolt 21 securing the hand grip 25 between the crutch arms 15A and 15B, and then withdrawing the bolt 21 from the crutch arms and the hand grip. An appropriate pair of hand grip adjustment apertures 61A and 61B in the crutch arms 15A and 15B is then selected to position the hand grip 25 at a comfortable height for the crutch user. The flaps 19A and 19B of the pack 11 are located against the crutch arms 15A and 15B, respectively, with the coupling apertures 57 in the flaps aligned with the selected hand grip apertures 61A and 61B in the crutch arms. The shaft of the bolt 21 is then extended through the coupling apertures 57 in the flaps 19A and 19B, the selected hand grip apertures 61A and 61B, and the hand grip 25, and then the nut 23 is tightened about the end of the bolt 21 to securely fasten the pack 11 and the hand grip to the crutch 13.

The pack 11 may then be stabilized on the crutch 13 by securing the straps 27U and 27L around the crutch. The strap portions 27A and 27B of each strap 27U and 27L are pulled taut so that the back wall 17 of the pack 11 is firmly located against the crutch arms 15A and 15B. The strap portions 27A and 27B are then wrapped around the crutch 13 until the coupling ends 67 of the strap portions overlap. The fasteners 69 at the coupling ends of the strap portions 27A and 27B are secured together while cinching the straps about the crutch 13 so the pack is held firmly to the crutch. The straps keep the pack from bouncing on the crutch 13.

Once in place on the crutch 13 the pack 11 may be used to carry a variety of items. Keys may be located in the cavity 37 or the pockets 71, 77 or 89. Pencils and pens may be located in the outer side pockets 83. Notes, paper, a wallet and other useful items may be located in the cavity 37 or the pockets 71, 77, or 89 as well. The items are secured within the pack 11 by the top wall 47 and the flap 105.

After the items are located in the pack 11, a crutch user can use both hands to manipulate and walk on the crutches. When the user needs an item in the pack 11, the pack 11 is located at hand level on the crutch 13 so the items within the pack may be easily accessed by reaching into the pack with one hand while hold the crutch. If preferred, the crutch may be leaned against a wall so that the pack may be accessed to retrieve items from the pack.

The foregoing disclosure and showings made in the drawings are merely illustrative of the principles of this invention and are not to be interpreted in a limiting sense.

We claim:

1. A carrying pack for attachment to a crutch, comprising:

a) a bag having plural walls coupled together about a cavity with a pouch opening in at least one of said walls, where said pouch opening communicates with said cavity, said cavity being capable of receiving items for storage through said pouch opening, one of said walls being a first wall;

b) first and second flaps coupled to a first wall of said bag extending along said first wall and extending out from said first wall, said first and second flaps being spaced apart to receive said crutch therebetween;

c) a first opening located in said first flap for receiving a crutch handle bolt therethrough when said first flap is located along a first arm of said crutch;

d) a second opening located in said second flap opposing said first opening in said first flap, said second opening being positioned to receive said crutch handle bolt therethrough when said second flap is located along a second arm of said crutch;

e) a support strap coupled to said first wall and extending outwards from said first wall, said strap having coupling means for coupling said strap about said crutch to stabilize said bag on said crutch.

2. The carrying pack of claim 1, further comprising a grommet located in each of said first and second openings in said first and second flaps, respectively.

3. The carrying pack of claim 1, further comprising an inner pocket located within said cavity in said bag, said inner pocket being formed by an inner pocket wall coupled to one of said walls.

4. The carrying pack of claim 1, further comprising:

a) a top portion integrally coupled to said first wall adjacent said pouch opening;

b) coupling means for removably coupling said top portion over said pouch opening to each of said walls except said first wall.

5. The carrying pack of claim 1, further comprising an outer pocket located outside one of said walls and being formed by an outer pocket wall coupled to said one wall.

6. The carrying pack of claim 5, further comprising:

a) a pocket flap integrally coupled to one of said walls extending over said outer pocket wall and an outer pocket opening;

b) means for removably coupling said pocket flap to said outer pocket wall over said outer pocket opening.

7. An apparatus, comprising:

a) a crutch having first and second arms and having a crutch handle extending between said first and second arms;

b) means for securing said crutch handle between said first and second arms;

c) a bag having plural walls coupled together about a cavity with a pouch opening in at least one of said walls where said pack opening communicates with said cavity, said cavity being capable of receiving items for storage through said pouch opening, one of said walls being a first wall;

d) first and second flaps secured to said first wall of said bag extending along said first wall and extending out from said first wall;

e) said first wall being located adjacent said crutch extending between said first and second arms of said crutch;

f) said first flap being located extending along said first arm of said crutch and being coupled thereto by said means for securing said crutch handle;

g) said second flap being located extending along said second arm of said crutch and being coupled thereto by said means for securing said crutch handle.

8. The apparatus of claim 7, further comprising:

a) a support strap coupled to said first wall of said bag;

b) said support strap extending about said first and second arms of said crutch;

c) strap coupling means for coupling said strap about said crutch to stabilize said bag on said crutch.

9. The apparatus of claim 7, further comprising:

a) said means for securing said crutch handle comprises a bolt and nut;

b) a first opening is located in said first flap for receiving said bolt therethrough, said first flap being secured to said first arm by said bolt;

c) a second opening is located in said second flap for receiving said bolt therethrough, said second flap being secured to said second arm by said bolt.

10. The apparatus of claim 9, further comprising a grommet located in each of said first and second openings in said first and second flaps, respectively.

11. The apparatus of claim 7, further comprising an inner pocket located within said cavity in said bag, said inner pocket being formed by an inner pocket wall coupled to one of said walls.

12. The apparatus of claim 7, further comprising an outer pocket being located outside of one of said walls and being formed by an outer pocket wall coupled to said one wall.

13. The apparatus of claim 7, further comprising:

a) a pocket flap integrally coupled to one of said walls extending over said outer pocket wall and an outer pocket opening;

b) means for removably coupling said pocket flap to said outer pocket wall over said outer pocket opening.

14. The apparatus of claim 7, further comprising:

a) a top portion integrally coupled to said first wall adjacent said pouch opening;

b) coupling means for removably coupling said top portion over said pouch opening to each of said walls except said first wall.

* * * * *